US005690274A

United States Patent [19]

Yang

[11] Patent Number: 5,690,274

[45] Date of Patent: Nov. 25, 1997

[54] FOLDING BOX STRUCTURE

[76] Inventor: Hsi-Chin Yang, No. 33-4, HuaMei Lane, ChungCheng Road, TaYa Hsiang, TaiChung Hsien, Taiwan

[21] Appl. No.: 735,427

[22] Filed: Oct. 22, 1996

[51] Int. Cl.[6] ..... B65D 5/36

[52] U.S. Cl. ..... 229/117; 229/23 R

[58] Field of Search ..... 229/117, 23 R, 229/931

[56] References Cited

U.S. PATENT DOCUMENTS

| | | | |
|---|---|---|---|
| 940,781 | 11/1909 | Bird | 229/23 R |
| 940,782 | 11/1909 | Bird | 229/23 R |
| 1,156,250 | 10/1915 | Scott | 229/23 R |
| 1,652,844 | 12/1927 | Van Wormer | 229/23 R |
| 4,463,997 | 8/1984 | Densen | 229/23 R |
| 5,150,646 | 9/1992 | Lenczak | 229/23 R |

*Primary Examiner*—Gary E. Elkins

*Attorney, Agent, or Firm*—Ostrolenk, Faber, Gerb & Soffen, LLP

[57] ABSTRACT

The present invention relates to a folding box structure and in particular to a folding box structure in which a box consists of two identical components. Each of the components includes a back panel which is adjacent above to a lid panel and below to a bottom panel. The back panel adjoins on its two sides respectively an adhesive flap and a side panel. A trapezoidal-like recess is formed on the bottom panel along the outer edge. A crease is formed across from the joint of the bottom panel and the bottom side panel to the nearest vertex of the recess. Perforation is also provided along the crease for the ease of bending. These two components are engaged with each other by affixing the overlapping portions and by fitting together projections and recesses to form a box. A folding box in this structure can easily be folded and extended without further adhesion.

4 Claims, 5 Drawing Sheets

FOLDING BOX STRUCTURE

FIELD OF THE INVENTION

The present invention relates to a folding box structure and in particular to a folding box structure in which a box can be folded to store away for future use and extended when in time of need without stapling or taping the box. Accordingly, a box in such structure can be repeatedly used without bearing scars or being damaged resulting from the removal of staples or adhesive tapes.

BACKGROUND OF THE INVENTION

Cartons for packaging agricultural products, electric appliances, or other solid objects, are often partially assembled in the manufacturing factory; the bottom and top flaps are left unstapled and untaped so that the cartons may lay flat to exhibit their two-dimensional configuration for the ease of carrying and shipping. A carton can be extended to hold solid objects by stapling or taping the bottom flaps. When the carton is not in use, the staples or adhesive tapes used to join the bottom flaps are then removed in order to flatten the carton so as to minimize the space occupied by the empty carton. However, in the process of removing the staples and adhesive tapes, the surface of the carton may be blemished or the carton itself may be damaged. Many users would hence rather discard used cartons than keep them for re-use.

It is therefore desirable to provide a folding box structure to overcome the aforementioned problems and thus to prolong the use of boxes.

SUMMARY OF THE INVENTION

The primary object of the present invention is to provide a folding box structure in which a box is manufactured in a manner so that it is easy to fold after use and equally easy to extend when in time of need without stapling or taping the box. A folding box in its two-dimensional configuration may easily be converted to its three-dimensional configuration by simply extending the box so as to avoid the need of adhesion which poses potential for causing the surface defacement of the box or even the damage of the box itself in the process of removing adhesive.

A folding box in accordance with the present invention consists of two identical components, each of which is a boxboard of polygon in its two-dimensional configuration. Each component includes a back panel which is adjacent above to a lid panel and below to a bottom panel. The back panel adjoins on its two sides respectively an adhesive flap and a side panel. Below the side panel is a bottom side panel. A recess is formed on the bottom panel. These two components are engaged with each other by overlapping and by the fitting together of projections and recesses to form a box.

Other features and advantages of the present invention will become apparent during the course of the following description.

BRIEF DESCRIPTION OF THE INVENTION

DETAILED DESCRIPTION OF THE INVENTION

Figure 1:
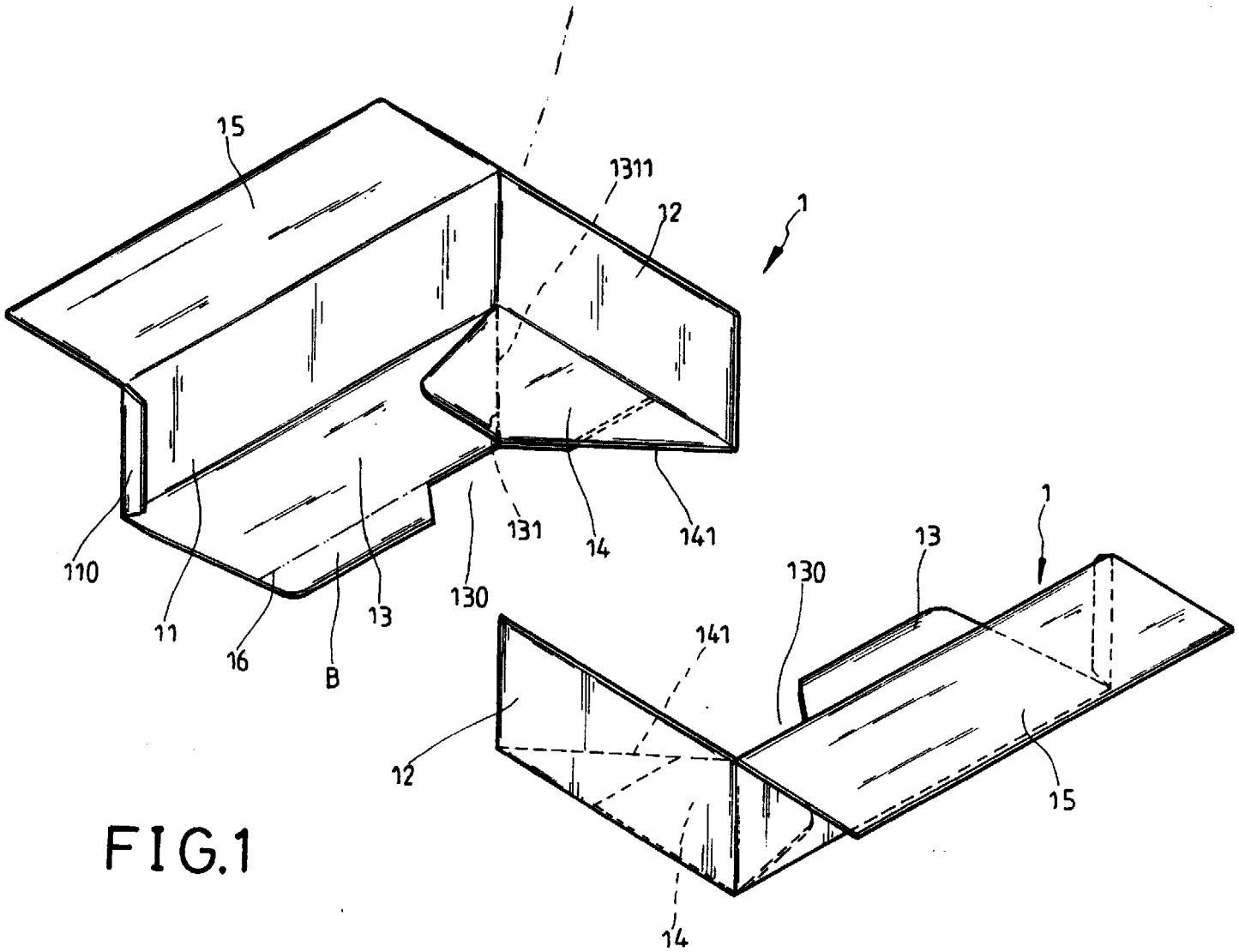
FIG. 1 is an exploded view of the present invention showing spatial relationship between two identical components of the present invention.

Referring to the drawings in detail wherein like numerals designate like parts and particularly to FIG. 1, a folding box in accordance with the present invention comprises two identical components 1 which are carved out of boxboard in a required shape so that each component 1 consists of a back panel 11 which is adjacent above to a lid panel 15 and below to a bottom panel 13. The back panel 11 adjoins on its two sides respectively an adhesive flap 110 and a side panel 12. Below the side panel 12 is a bottom side panel 14. A trapezoidal-like recess 130 is formed on the bottom panel 13 with the greater base locating at the outer edge of the bottom panel 13. A crease 131 is formed across from the joint of the bottom panel 13 and the bottom side panel 14 to the nearest vertex of the recess 130. Each component 1 of such polygon as described above can be bent to exhibit its three-dimensional configuration in a manner that the bottom panel 13 and the side panel 12 are each perpendicular to the back panel 11 in different orientation and that the bottom side panel 14 is perpendicular to the side panel 12. The gradient of the outer side of the bottom side panel 14 is adapted to agree with the gradient of the nearer leg of the trapezoidal-like recess 130 so that the overlapping portions of the bottom part of the bottom panel 13 defined by the crease 131 and the bottom side panel 14 are joined with glue or other adhesive.

Figure 2:
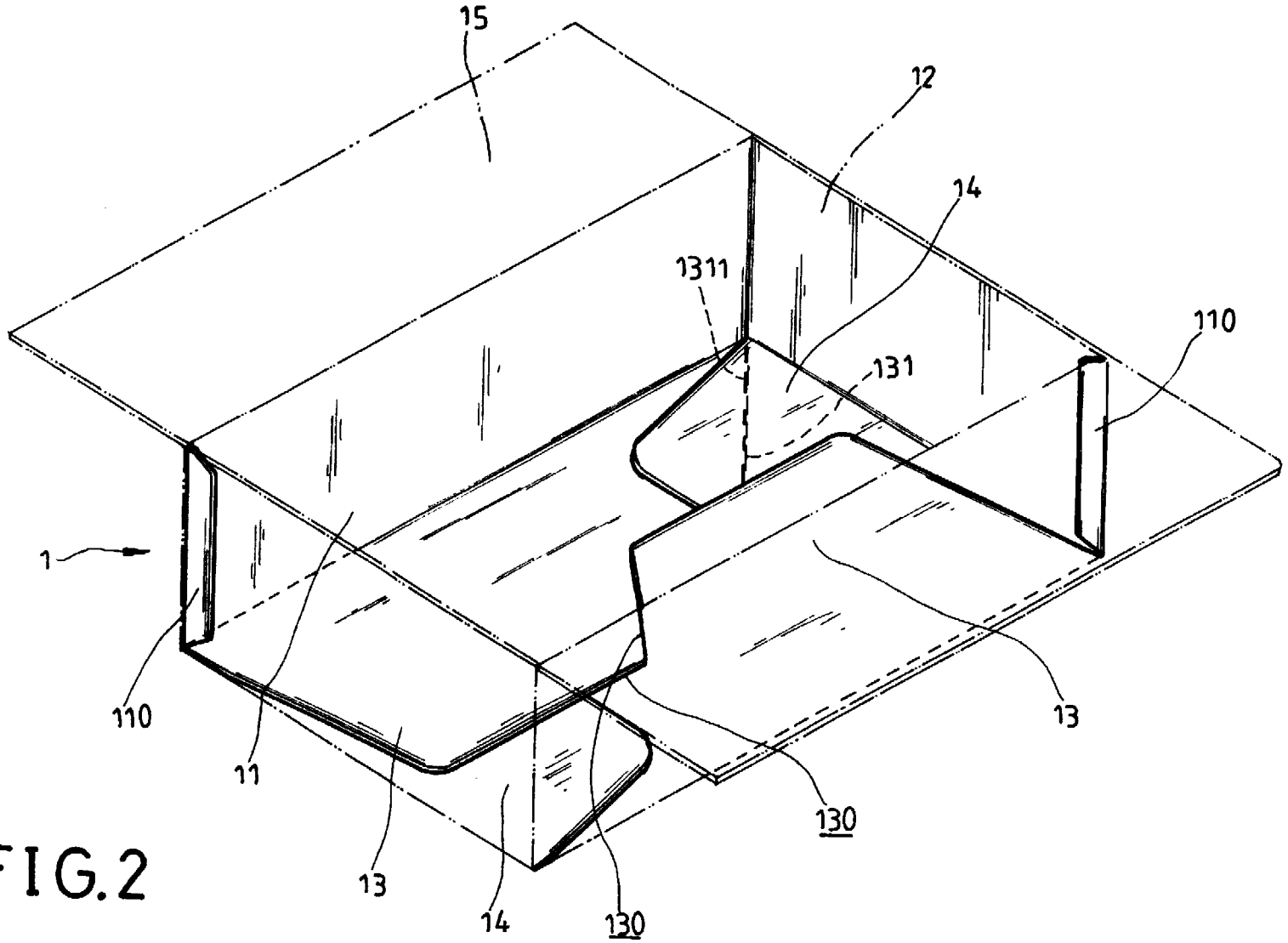
FIG. 2 is a perspective view of FIG. 1 showing extended configuration of the present invention.

As shown in FIG. 2, these two identical components 1 are then assembled in the manufacturing factory by affixing the adhesive flap 110 of each component 1 to the corresponding inner surface of the side panel 12 of the other component 1 and by placing portion B of each bottom panel 13 onto the corresponding part of the other component 1, where portion B is defined by an imaginary line 16 on the bottom panel 13 extending from the smaller base of the trapezoidal-like recess 130, the side edge of the bottom panel 13 farther from the side panel 12, the outer edge of the bottom panel 13, and the nearer leg of the trapezoidal-like recess 130 to the said side edge. Consequently, these two components 1 engage with each other by overlapping and by the fitting together of projections and recesses, and the strength needed to support the reasonable load therein is thus provided by the interlock between these two components 1.

Figure 3:
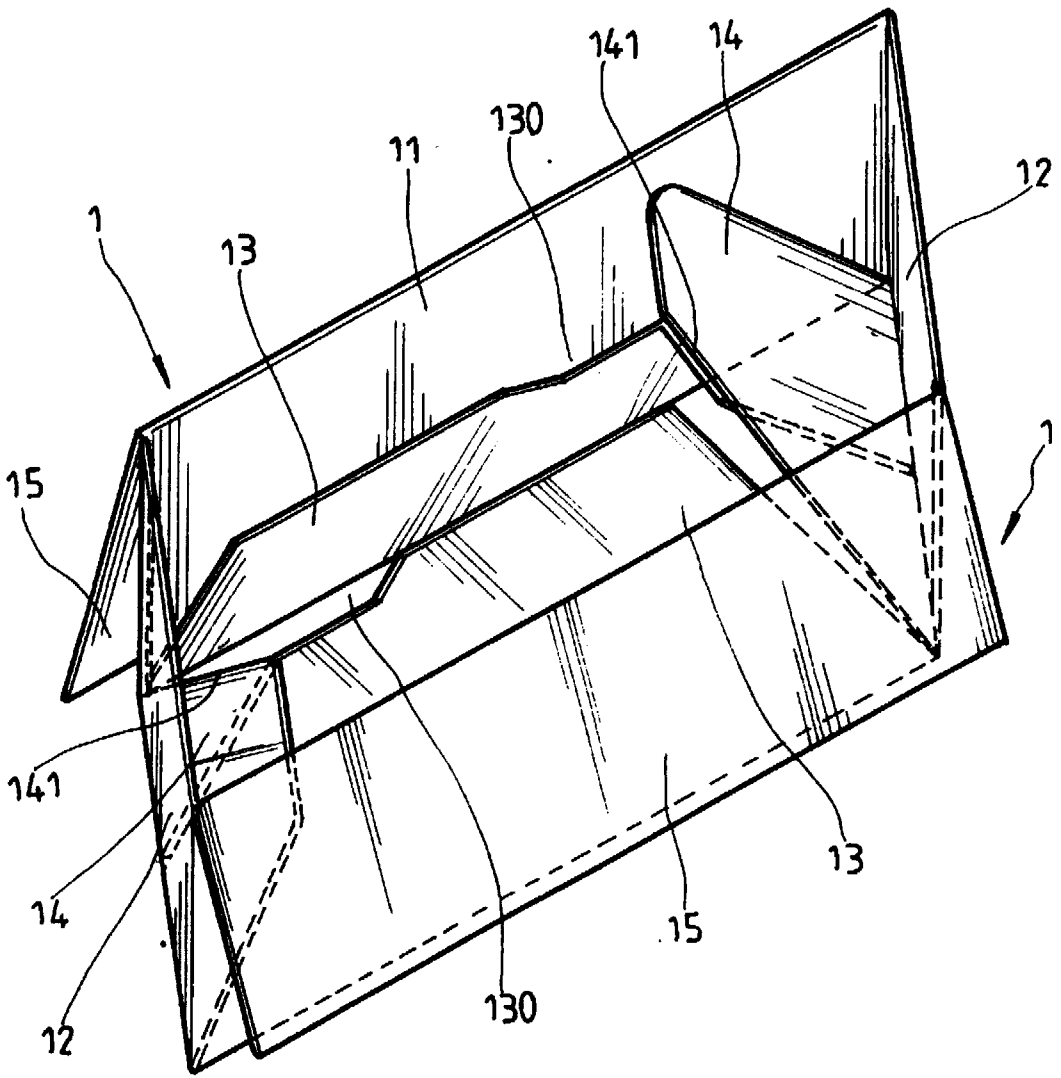
FIG. 3 is a perspective view of FIG. 1 showing folded configuration of the present invention.
Figure 4:
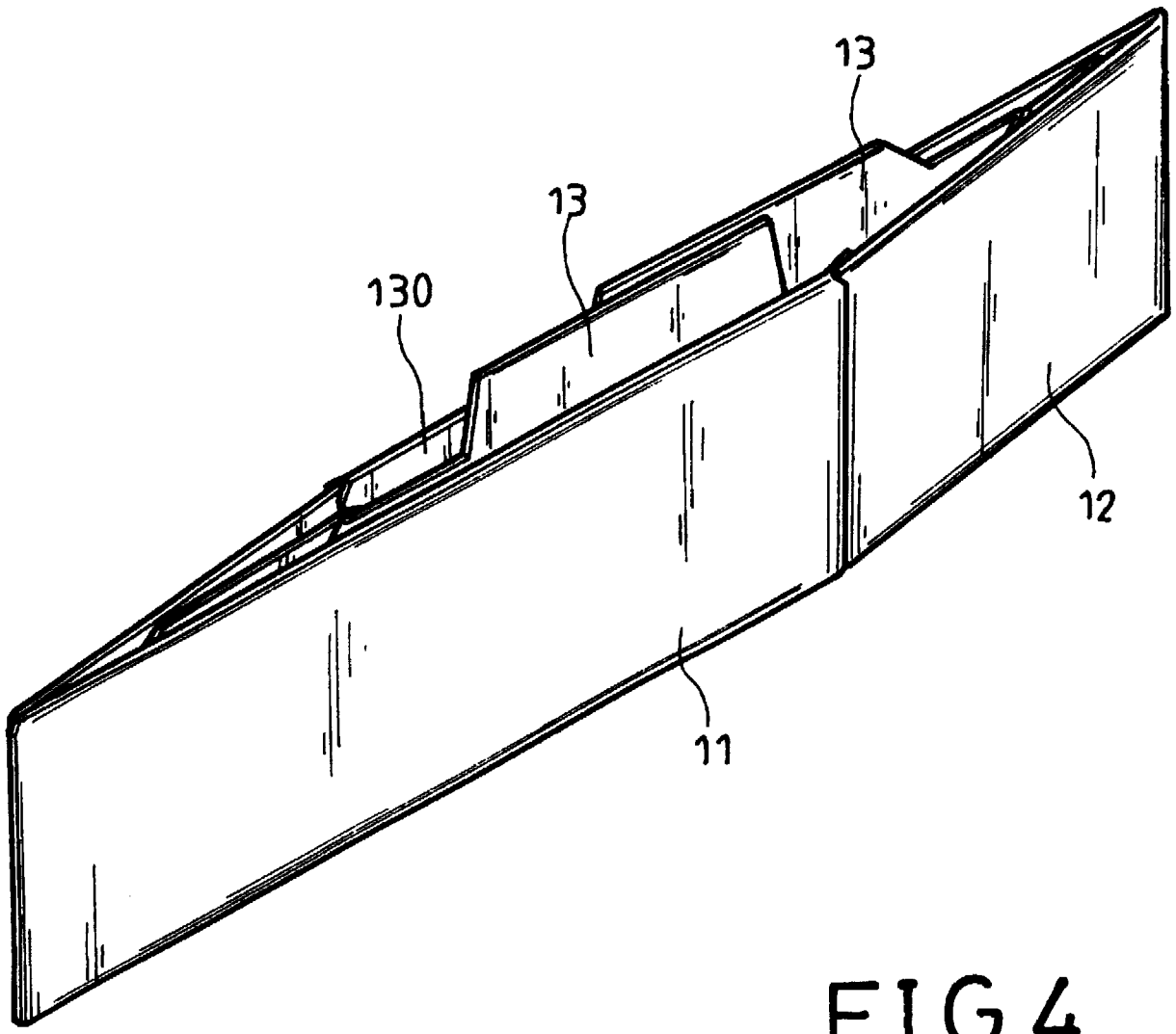
FIG. 4 is another perspective view of FIG. 3.

FIG. 3 and FIG. 4 show folded configuration of the folding box of FIG. 1. According to this structure, the folding box not in use can be folded to make it compact for storing by simply pushing against the joint of two bottom panels 13 from outside of the box. The force then causes these two bottom panels 13 as well as both bottom side panels 14 to flip upwards, as shown in FIG. 3. Since the components 1 are made of boxboard of sufficient thickness, perforations 1311 are provided along the crease 131 to make such bending easier. When the flipped bottom panels 13 and the bottom side panels 14 become virtually perpendicular to each other, we may then exert pressure on both the back panels 11 and the side panels 12 to flatten the box into its two-dimensional configuration, as shown in FIG. 4. A folding box in this structure can also easily be extended by the same principle when in time of need.

Figure 5:
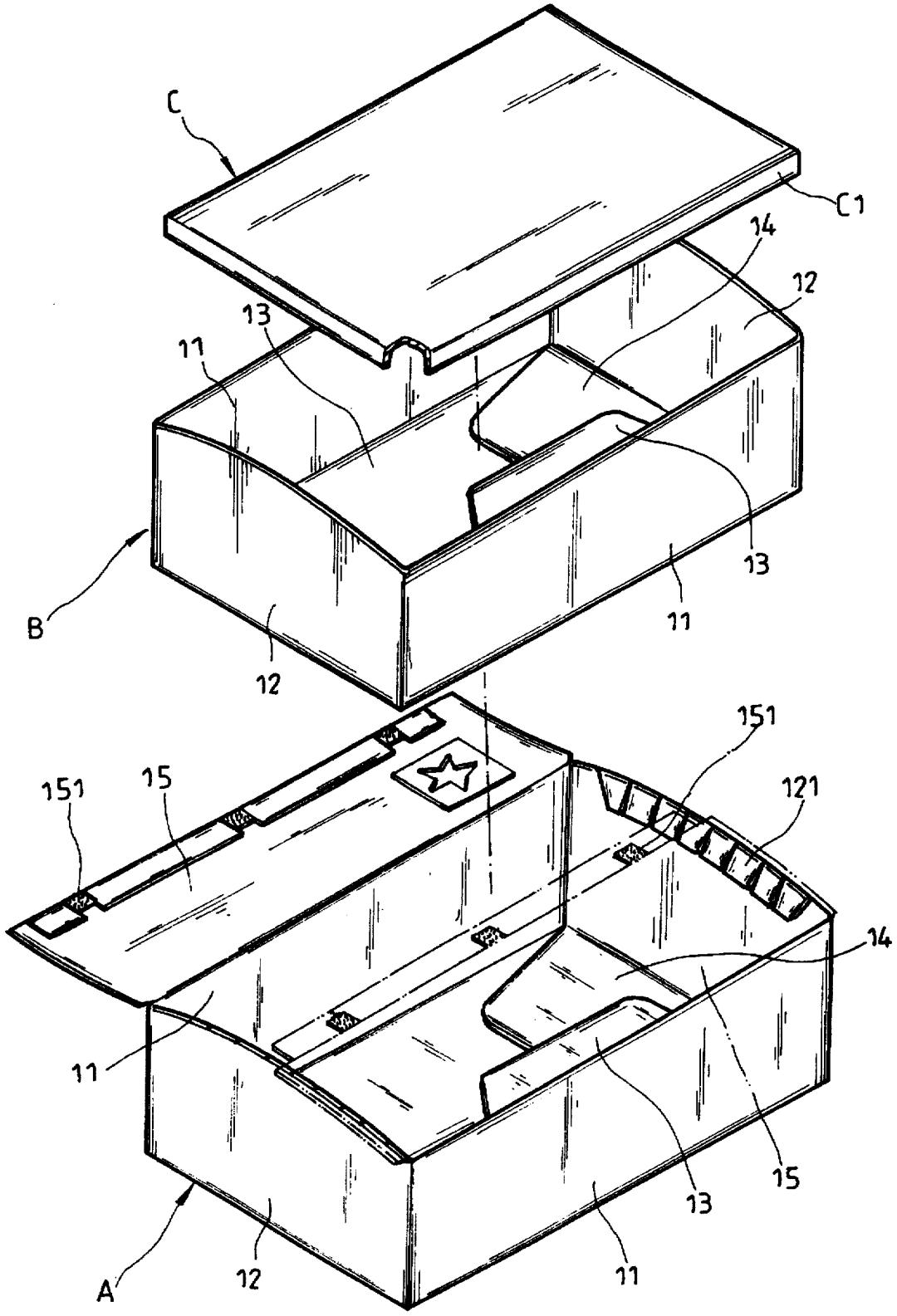
FIG. 5 is an exploded view of another embodiment of the present invention functioned as a coffin for dead pets.

Folding boxes according to the present invention can be utilized not only for packaging commercial goods, but also for burying dead bodies of pets. FIG. 5 shows an exploded view of another embodiment of the present invention, a coffin for burying a dead body of pet. It consists of two folding boxes in accordance to the present invention: an outer box D and an inner box E. The scallop trim along the top edge of each side panel 12 of the outer box D can be added for decoration purpose. A plurality of buckles 151 can be fixed to the corresponding positions of the top edge of each lid panel 15 to join the two lid panels 15 in order to close the box. The structure of the inner box E is basically the same as the structure of the outer box D except that the inner box E does not comprise lid panels and that the dimension of the inner box E is smaller in order to fit in the outer box D. A backing F disposed within the inner box E is also provided for stronger support of the load of the box. The backing F is a rectangular boxboard with its edges bent perpendicularly downwards so that when the backing F is placed inside the inner box E, a distance is formed between the backing F and the bottom of the inner box E. Since the periphery of the bottom provides stronger support, this may alleviate the weight burdened by the central portion of the bottom of the inner box E by spreading the weight to the boundary of the bottom of the inner box E, on which the backing F stands.

It is to be understood that the forms of the invention herewith shown and described are to be taken as preferred examples of the same and that various changes in the shape, size, and arrangement of parts may be resorted to, without departing the spirit of the invention or scope of the accompanying claims.

What is claimed is:

1. A folding box structure comprising two identical components, each of the components comprising a back panel which is adjacent above to a lid panel and below to a bottom panel; the back panel having two sides respectively comprising an adhesive flap and a side panel joined thereto; a bottom side panel being formed below the side panel; a recess being formed on the bottom panel located at an appropriate position along the outer edge, and gradient of the side near the bottom side panel corresponding with gradient of the outer side of the bottom side panel; a crease being formed across from the joint of the bottom panel and bottom side panel to the nearest vertex of the recess; the underside portion of the bottom panel defined by the perforations being joined with the corresponding overlapping of the bottom side panel; the two components being assembled to form a box by affixing the adhesive flap of each component to the corresponding inner surface of the other component.

2. The folding box structure as claimed in claim 1, wherein the shape of the said recess is trapezoidal with the greater base located on the outer edge of the said bottom panel.

3. The folding box structure as claimed in claim 1, wherein the said overlapping portion of the bottom panel and the bottom side panel is joined with adhesive.

4. The folding box structure as claimed in claim 1, wherein perforation is formed along the said crease.

* * * * *